US005395123A

United States Patent [19]

Kondo

[11] Patent Number: 5,395,123

[45] Date of Patent: Mar. 7, 1995

[54] SYSTEM FOR MARKING A SINGING VOICE AND DISPLAYING A MARKED RESULT FOR A KARAOKE MACHINE

[75] Inventor: Tadami Kondo, Gifu, Japan

[73] Assignee: Kabushiki Kaisha Nihon Video Center, Nagoya, Japan

[21] Appl. No.: 91,159

[22] Filed: Jul. 13, 1993

[30] Foreign Application Priority Data

Jul. 17, 1992 [JP] Japan ..... 4-213335

[51] Int. Cl.[6] ..... A63B 65/00

[52] U.S. Cl. ..... 273/454; 381/56; 84/615; 434/307 A

[58] Field of Search ..... 84/464 A, 464 R, 477 R, 84/615; 434/307 A; 273/454

[56] References Cited

U.S. PATENT DOCUMENTS 4,546,687 10/1985 Minami ..... 84/477 R 5,208,413 5/1993 Tsumura et al. ..... 84/615

*Primary Examiner*—Curtis Kuntz

*Assistant Examiner*—Mark D. Kelly

*Attorney, Agent, or Firm*—Koda and Androlia

[57] ABSTRACT

A system for marking a singing voice and displaying a marked result for a karaoke machine. The system comprises a data storage means, a comparison and marking means, a display means, a control mean. The data storage means stores a standard singing voice data on a basis of which a singing voice of a singer inputted from a microphone is marked. The comparison and marking means compares the singing voice with the standard singing voice data and marks the singing voice. The display means displays a result of a score of the singing voice marked by the comparison and marking means, and has a course which is composed of a series of display units and a goal display. The control means controls the display means. The control means illuminates the display units of the number corresponding to the marked score, also illuminates the goal displays if the marked score reaches a predetermined perfect score, and increases or decreases the number of the illuminating display units by the predetermined and also the marked score according to the increasing or the decreasing number of the illuminating display units if the marked score belongs to a predetermined range of scores.

4 Claims, 8 Drawing Sheets

SYSTEM FOR MARKING A SINGING VOICE AND DISPLAYING A MARKED RESULT FOR A KARAOKE MACHINE

BACKGROUND OF THE INVENTION

The present invention relates to a system for marking a signing voice and displaying a marked result for a karaoke machine, which system compares a singing voice signal with a standard singing voice data on a basis of which the singing voice signal is marked when the singing voice signal is inputted from a microphone, and further displays a result of a marked score of the singing voice signal by light-emitting diodes or Braun tubes.

Publication of unexamined Japanese utility model application No. 3-119870 discloses a system for marking a singing voice and displaying a marked result for a karaoke machine as illustrated in FIG. 8. The conventional system comprises microphones 1*a*~3*a*, filters 1*b*~3*b*, frequency voltage converters 1*c*~3*c*, A/D converters 1*d*~3*d*, signal storage units 1*e*~3*e*, a comparison unit 16, a data storage unit 17, a sound source 21, CPU 18, a video RAM 20, and a display unit 19. The microphones 1*a*~3*a* are connected to the signal storage units 1*c*~3*e* via the filters 1*a*~3*a*, the frequency voltage converters 1*c*~3*c*, and A/D converters 1*d*~3*d*. The signal storage units 1*e*~3*e* are connected to the comparison unit 16, which is connected to the data storage unit 17. The data storage unit 17 is connected to the sound source 21. Meanwhile, the comparison unit 16 is connected to CPU 18, which is connected to the video RAM 20. The video RAM 20 is connected to the display unit 19.

The data storage unit 17 stores data on music and a standard singing voice data on a basis of which the singing voice signal is marked. The data on music is amplified by the sound source 21 and outputted from a speaker 22. When the singing voice signal is inputted from the microphone 1*a*, 2*a*, 3*a*, the filter 1*b*, 2*b*, 3*b* removes frequency components other than a voice frequency range. The frequency components of the voice frequency range are transmitted to the frequency voltage converter 1*c*, 2*c*, 3*c*, which converts the singing voice signal to an analogue voltage level predetermined according to its frequency. The A/D converter 1*d*, 2*d*, 3*d*, converts the analogue voltage level to a digital signal. The signal storage unit 1*e*, 2*e*, 3, stores the digital signal. The comparison and marking unit 16 compares the singing voice signal stored as the digital signal in the signal storage unit 1*e*, 2*e*, 3*e* with the standard singing voice data stored in the data storage unit 17 and marks the singing voice signal. The CPU 18 converts to a display data the singing voice signal marked by the comparison and marking unit 16. The display data is transmitted to the display unit 19 via the video RAM 20. The display unit 19 displays a result of the marked score. In this way the conventional system simply marks singing voices of singers and displays a result of marked scores. Therefore, such a system will soon lose popularilty of users.

SUMMARY OF THE INVENTION

In view of the foregoing, it is a main object of the invention to provide a system for marking a singing voice and displaying a marked result for a karaoke machine, which system can keep popularity of users for a long time.

It is an object of the invention to provide a system for marking a singing voice and displaying a marked result for a karaoke machine in which users can enjoy playing a game, as well as marking a larger score of singing voices.

To attain these objects, a system for marking a singing voice and displaying a marked result for a karaoke machine, said system comprises a data storage means for storing a standard singing voice data on a basis of which a singing voice of a singer inputted from a microphone is marked, a comparison and marking means for comparing the singing voice with the standard singing voice data and marking the singing voice, a display means for displaying a result of a score of the singing voice marked by the comparison and marking means, said display means having a course which is composed of a series of display units and a goal display, a control means for controlling the display means, said control means which illuminates the display units of the number corresponding to the marked score and illuminates the goal displays if the marked score reaches a predetermined perfect score and which increases or decreases the number of the illuminating display units by the predetermined number and the marked score according to the increasing or the decreasing number of the illuminating display unit if the marked score belongs to a predetermined range of scores.

According to the system of the present invention, a total score of the singing voice is displayed by the number of the illuminating display unit. Therefore, as the total score is larger, the number of the illuminating display units increases. Thus, it is easy to compare the singing voices of different singers. if the total score belongs to one of predetermined ranges of scores, all the illuminating display units stop illuminating or, the number of the illuminating display unit increases or decreases. Thus, with change in the number of the illuminating display unit, the total score also changes. Accordingly, even if a singer continues to make a large score, the number of the illuminating display units may not be large if the total score belongs to one of the predetermined ranges of the scores. As a result thereof, a singer, who makes a large total score, may be delayed in reaching the goal. In contrast thereto, a singer who continues to make a small total score may reach the goal earlier than a singer who continues to make a large total score, because the number of the illuminating display units showing the small total score can increase when the small total score belongs to one of predetermined ranges of the scores. That is, it depends on the predetermined ranges of the scores whether the total score can reach a perfect score, namely the goal, earlier. Thus, users of the system of the present invention can enjoy playing a game of contending for reaching the goal earlier, using the predetermined ranges of the scores, while making a larger score of the singing voice.

F5g. 8 is a block diagram illustrating a functional composition of a conventinal system for marking a singing voice and displaying a marked result for a karaoke machine.

DETAILED DESCRIPTION OF THE PREFERRED EMBODIMENT

Figure 1:
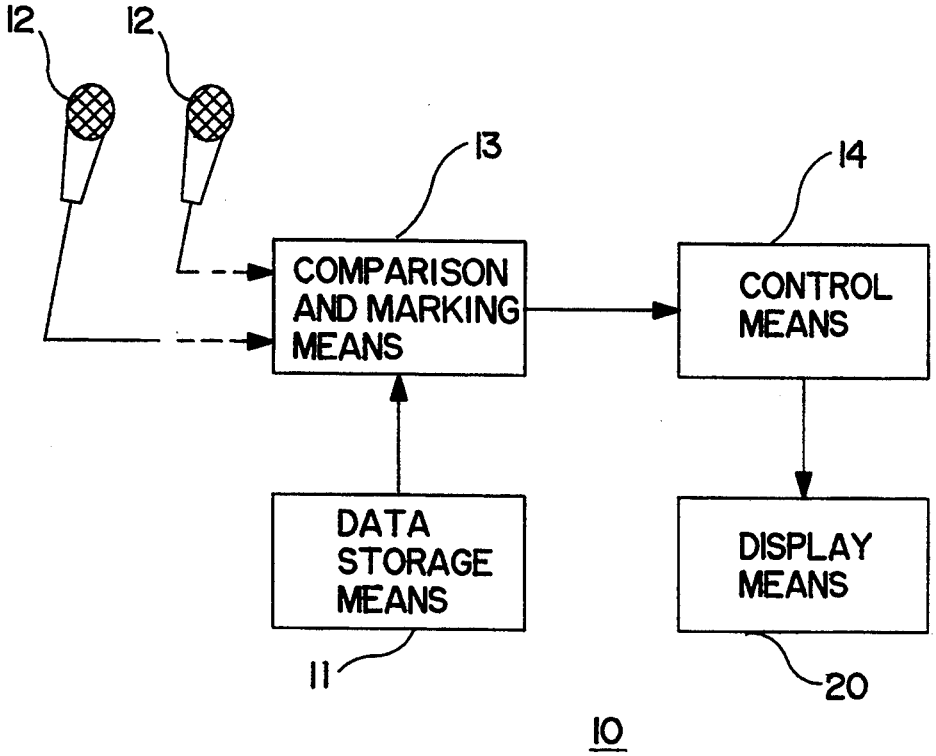
FIG. 1 PRIOR ART
FIG. 1 is a block diagram illustrating a functional composition of a system for marking a singing voice and displaying a marked result for a karaoke machine of a first embodiment of the present invention.

Referring first to FIG. 1, there is shown a block diagram of a functional composition of a system 10 for marking a singing voice and displaying a marked result for a karaoke machine according to a first embodiment of the present invention.

The system 10 comprises a data storage means 11, a comparison and marking means 13, a display means 20, and a control means 14. The data storage means 11 stores a standard singing voice data on a basis of which a singing voice of played music is marked. The comparison and marking means 13 compares a singing voice signal with the standard singing voice data when the singing voice signal is inputted from a microphone 12 via a filter, a frequency voltage converter, and an A/D converter (not illustrated) and the like. The display means 20 displays a result of a score marked by the comparison and marking means 13. The control means 14 processes the score marked by the comparison and marking means 13 and controls operation of the display means 20.

Figure 2:
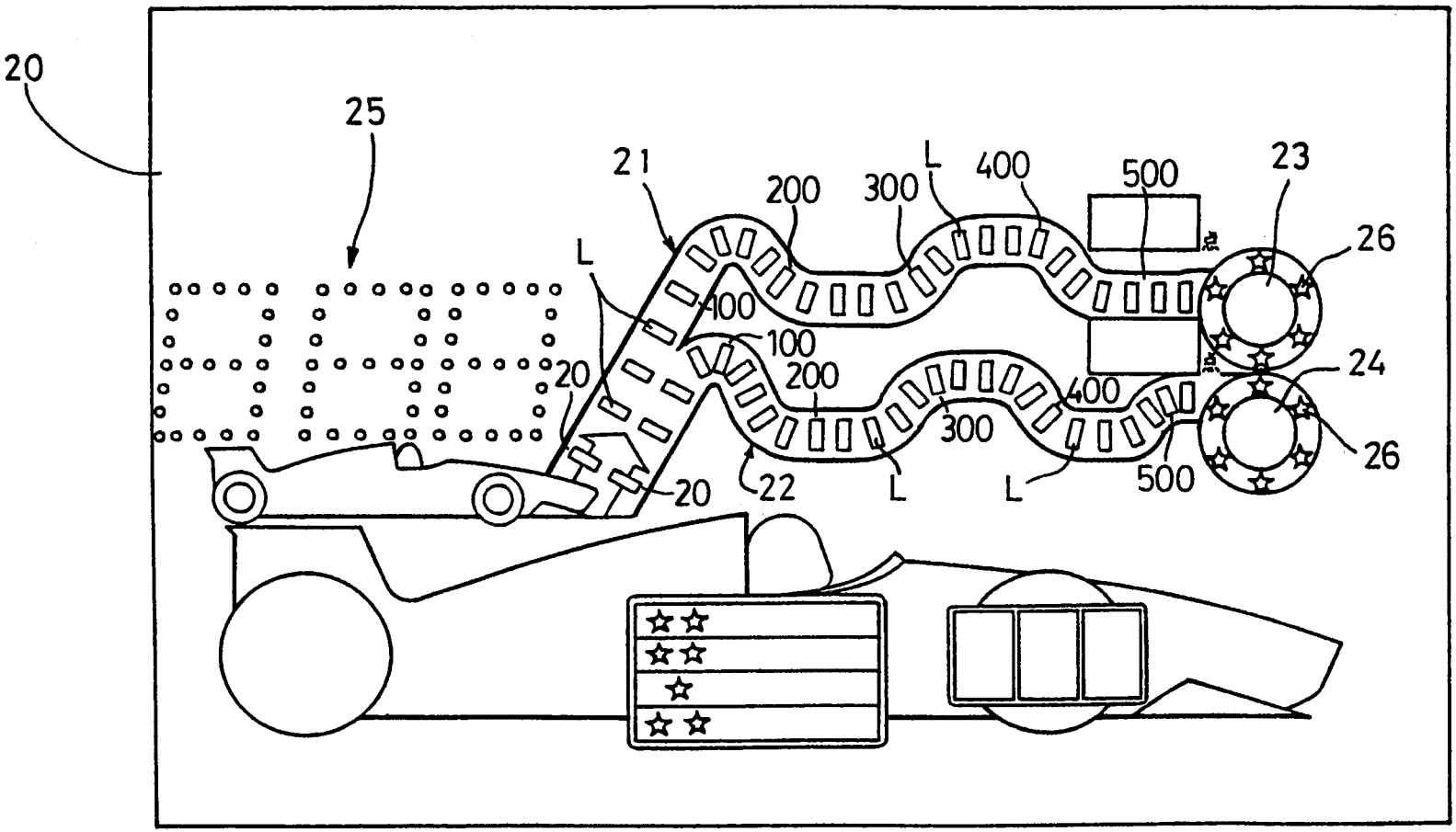
FIG. 2 is a plan view illustrating composition embodying a display means provided in the system.

FIG. 2 illustrates a composition embodying the display means 20. The display means 20 comprises two courses 21 and 22, goal displays 23 and 24, and a score display 25. The courses 21 and 22 are composed of a series of display units L disposed with a regular interval. The goal displays 23 and 24, which have star marks 26 arranged therearound, are provided in ends of the courses 21 and 22. The score display 25 is provided near starting points of the courses 21 and 22. Each of the display units L and the star marks 26 has light-emitting diodes provided therein. The light-emitting diodes cause the display units L and the star marks 26 to illuminate. The score display 25 is also composed of the light-emitting diodes to display a result of the marked score with a digital number.

Figure 3:
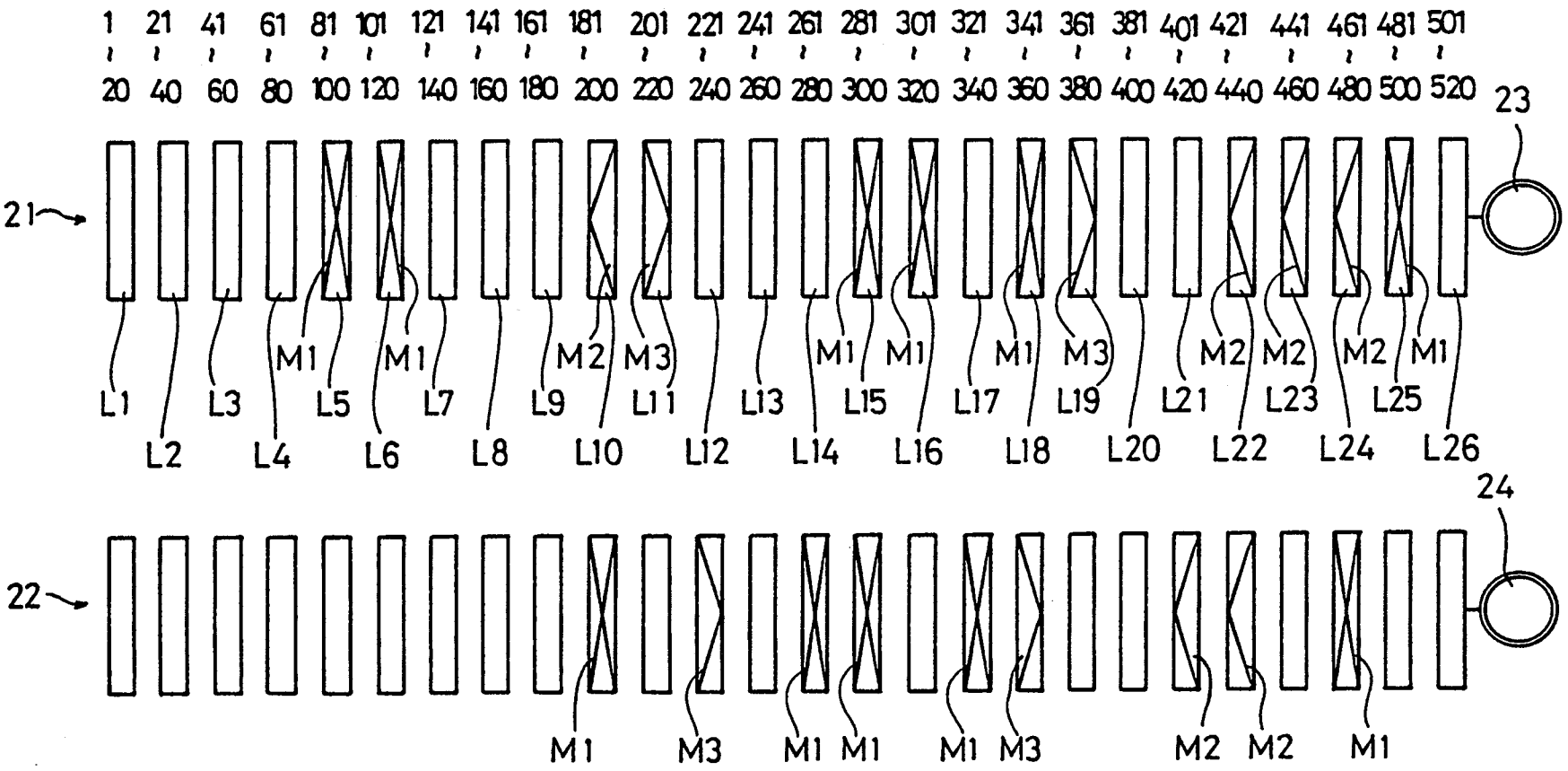
FIG. 3 is a typical plan view for explaining operation of the display means.
Figure 4:
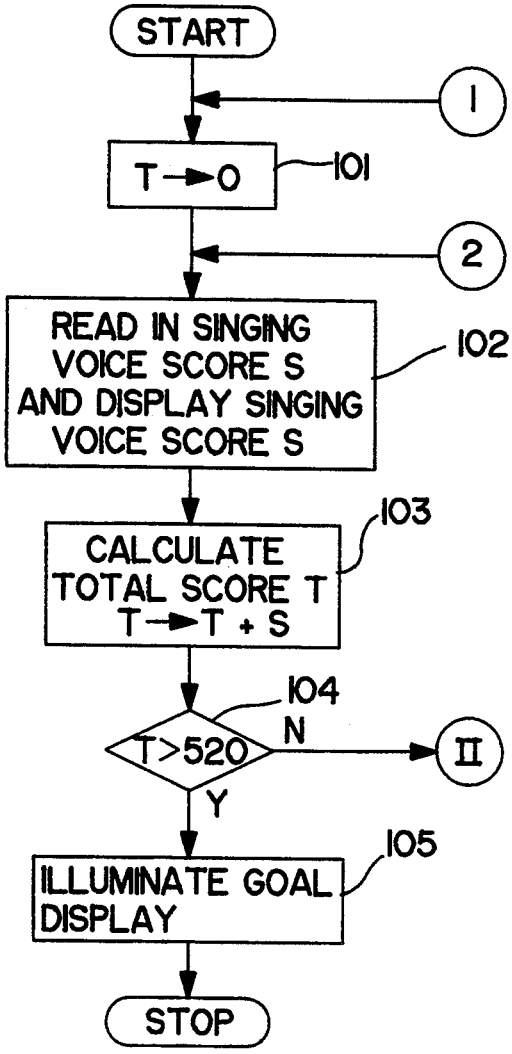
FIG. 4 to FIG. 7 are flow charts illustrating process of controlling the display means by a control means provided in the system.

FIG. 3 illustrates the courses 21 and 22 typically. The course 21 is composed of the display units L1 to L26 arranged in series. The display units L are adapted to illuminate by the light-emitting diodes. One unit of the display units L shows a score of 20 and the course 21 can display a total score of 560. In FIG. 3 three kind of marks, M1, M2, and M3, are attached to the display units L, to explain how the number of the illuminating display units L changes when a total score T belongs to predetermined ranges of scores to which M1, M2 and M3 are attached.

If the total score T belongs to the predetermined ranges of the scores to which the marks M1 are attached, the display units L illuminate up to the display unit L showing the total score T, then all of the the illuminating display units L stop illuminating. That is, if the total score T is 81 or more to 100 or less, the display units L1 to L5 illuminate once, then stop illuminating in the course 21.

If the total score T belongs to the predetermined ranges of the scores to which the marks M2 are attached, the display units L illuminate up to the display unit L showing the total score T once, then only the last illuminating display unit L stops illuminating. That is, if the total score T is 181 or more to 200 or less, the display units L1 to L10 illuminate once, then only the display unit L10 stops illuminating in the course 21. Thus, the number of the illuminating display units L decreases by one.

If the total score T belongs to the predetermined ranges of the scores to which the marks M3 are attached, the display units L illuminate up to the display unit L showing the total score T once, then the next display unit L also illuminates. That is, if the total score T is 201 or more to 220 to less the display units L1 to L11 illuminate once, then the display unit L12 also illuminate in the course 21. Thus, the number of the illuminating display units L increases by one.

In the present embodiment a microcomputer is used as the control means to control operation of the display means 20. Referring to flowcharts shown in FIG. 4 to FIG. 7, a process for controlling operation of the display means 20 by the control means 14 is explained. The flowcharts of FIG. 4 to FIG. 7 show the process for controlling operation of the display units L of which the course 21 is composed.

Figure 5:
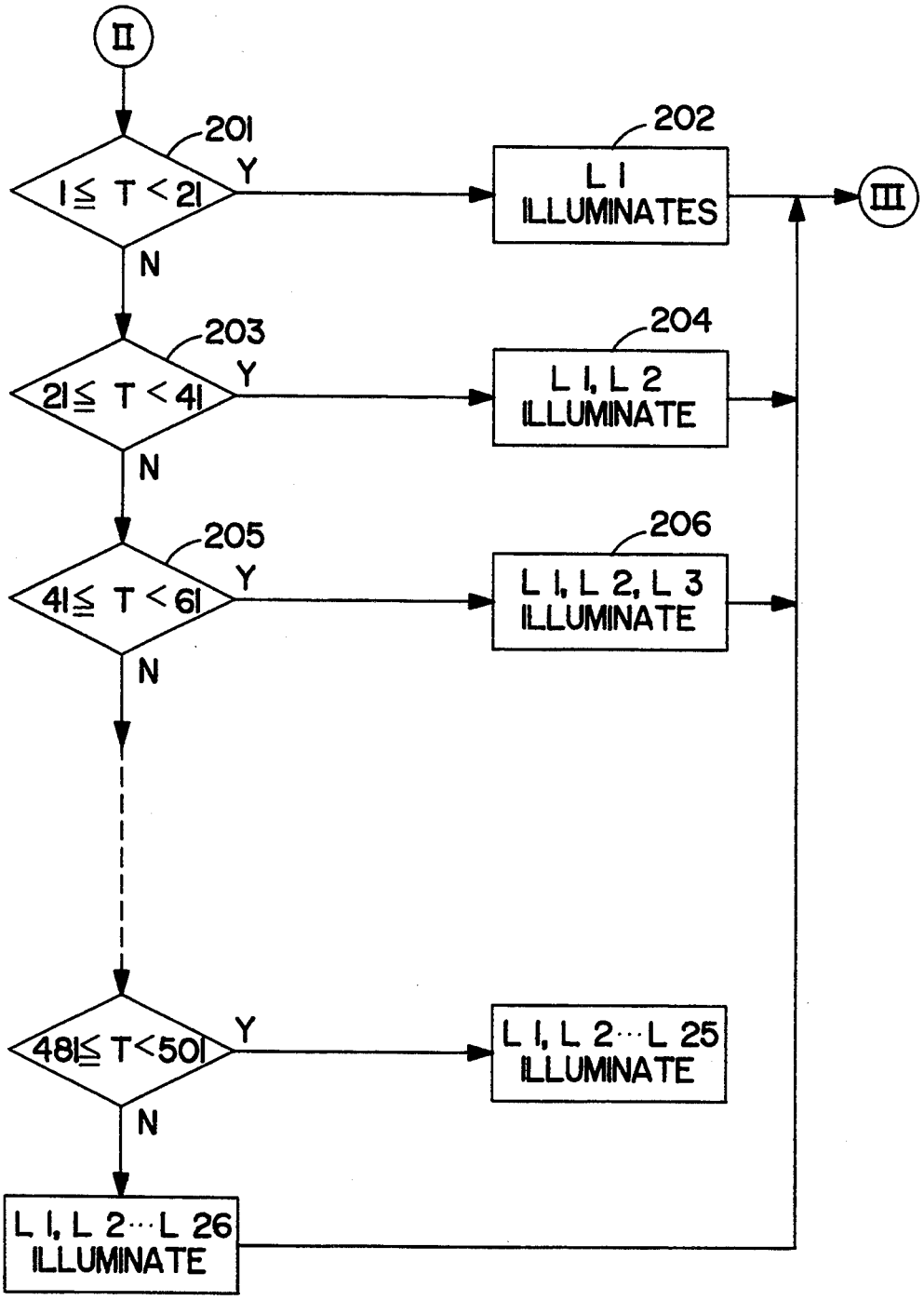

The microcomputer has an area for storing the total score T in a memory. In step 101 the total score T is set for 0 before the first singing voice of a singer is marked. When a singer sings a song with the microphone 12, a singing voice score S marked by the comparison and marking means 13 is read in and a marked score is displayed with a digital number in the score display 25 in step 102. In step 103 the singing voice score S is added to the stored total score T. In step 104 a check is made to determine whether or not the total score T is 520 or more. If the result of the determination in step 104 is positive, the goal display 23 illuminates, because a perfect score of the total score T is set for 520 in the present embodiment. If the result of the determination in step 104 is negative, a subroutine II of FIG. 5 is executed, in which subroutine further determinations are made so that the display units L are adapted to illuminate according to the total Score T. The subroutine II is executed as follows.

Figure 6:
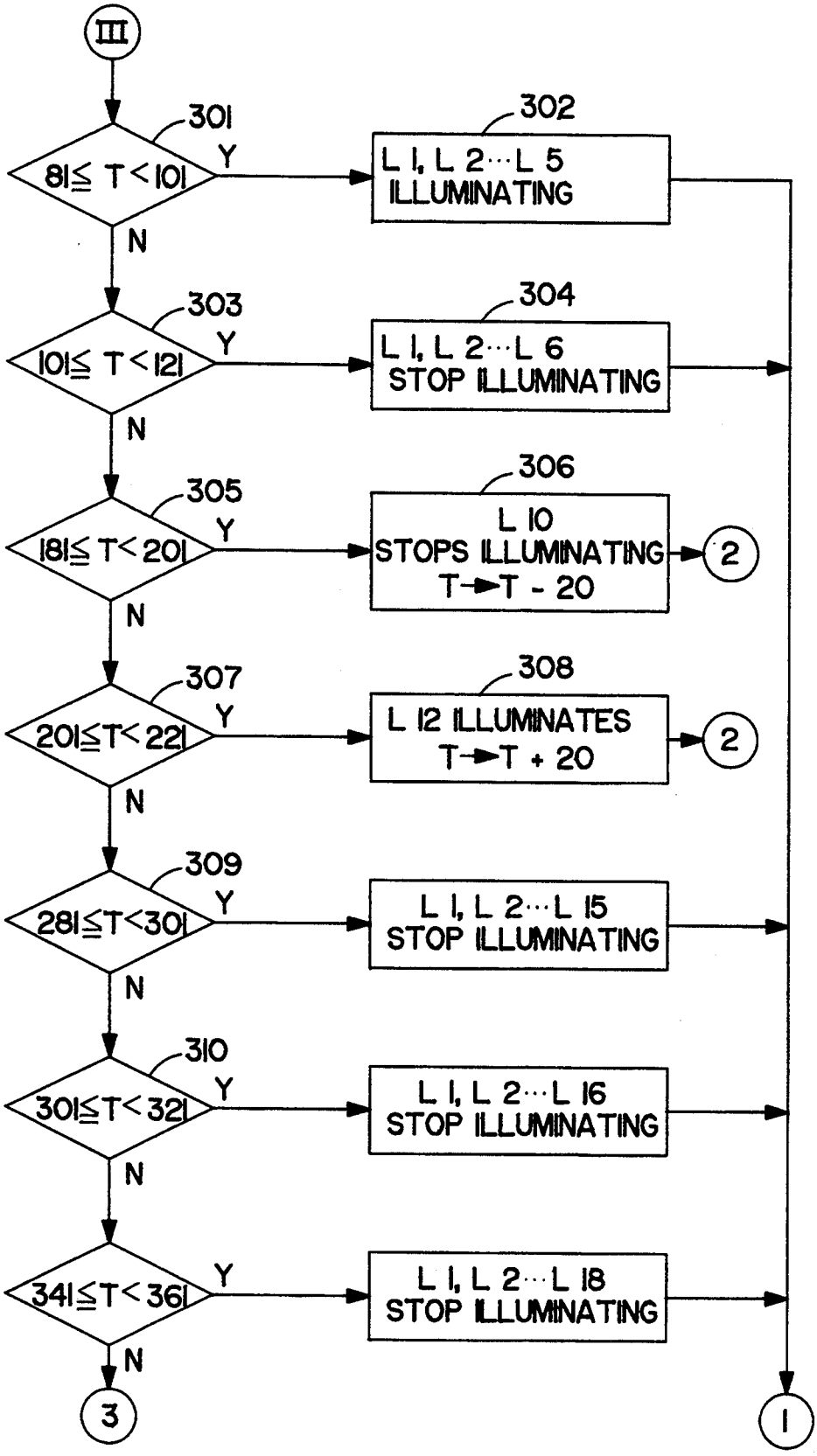
Figure 7:
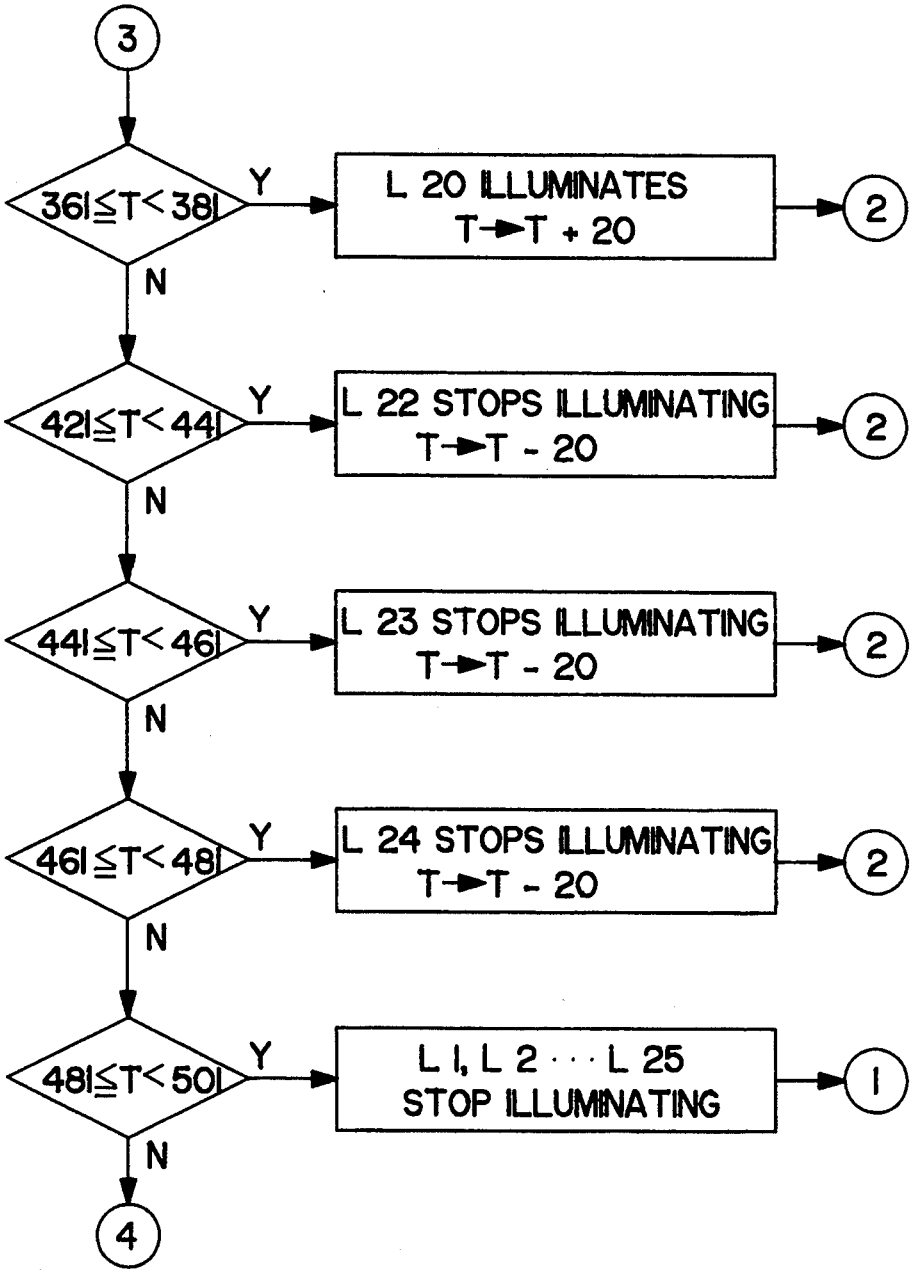
Figure 8:
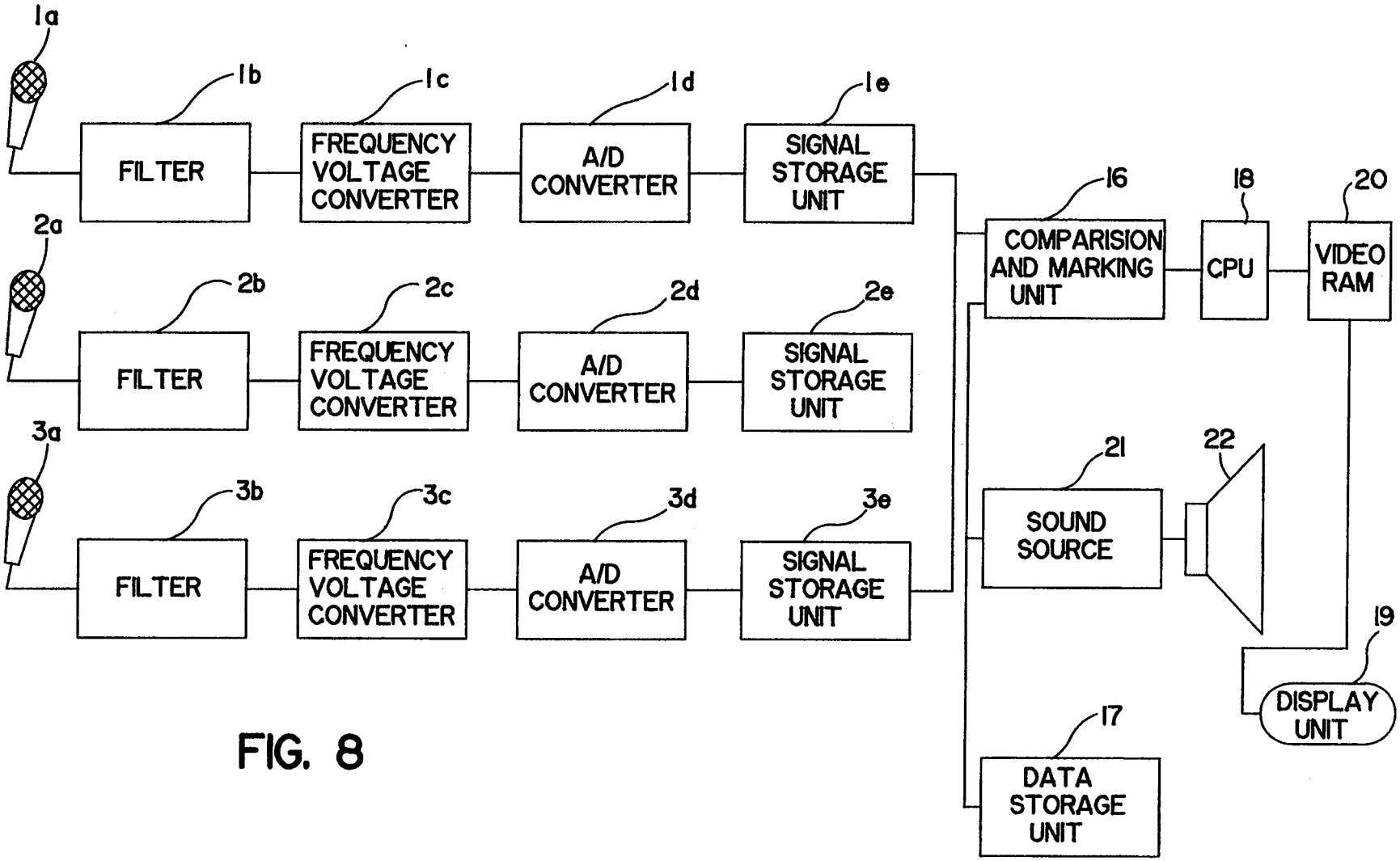

In step 201 a check is made to determine whether or not the total score T is 1 or more to below 21. If the result of the determination is step 201 is positive, the process continues to step 202, in which the first display unit L1 illuminates. When the first display unit L1 illuminates in step 202, a subroutine III of FIG. 6 and FIG. 7 is executed. If the result of the determination in step 202 is negative, the process continues to step 203, in which a check is made to determine whether or not the total score T is 21 or more to below 40. If the result of the determination is step 203 is positive, the process continues to step 204, in which the first and the second display units L1 and L2 illuminate. Then, the subroutine III is executed. If the result of the determination is step 203 is negative, the process continues to step 205, in which a check is made to determine whether or not the total score T is 41 or more to below 61. If the result of the determination is step 205 is positive, the process continues to step 206, in which first to the third display units L1 to L3 illuminate. In this way the display units L are adapted to illuminate according to the total score T, then the subroutine III is executed so that further determinations are made.

The subroutine III is executed as follows. In step 301 a check is made to determine whether or not the total score T is 81 or more to below 101. If the result of the determination in step 301 is positive, the process continues to step 302. If the result of the determination in step 301 is negative, the process continue to step 303. In step 302 the first to the fifth display units L1 to L5 illuminating in subroutine II stop illuminating and The process returns to step 101, in which the total score T is set for 0. Subsequently, The processes of 102 through 105 are executed.

In step 303 a check is made to determine whether or not the total score T is 101 or more to below 121. If the result of the determination is step 303 is positive, the process continues to step 304. If the result of the determination in step 303 is negative, the process continues to step 305. In step 304 the first to the sixth display units L1 to L6 illuminating in the subroutine II stop illuminating and the process returns to step 101.

In step 305 a check is made to determine whether or not the total score T is 181 or more to below 201. If the result of the determination is step 305 is positive, the process continues to step 306. If the result of the determination in step 305 is negative, the process continues to step 307.

In step 306, of the first through the tenth display units, L1 to L10 illuminating in the subroutine II, only the tenth display unit L10 stops illuminating, so that a score of 20 is subtracted from the total score T. The process returns to step 102 and the processes of step 103 through step 105 are executed.

In step 307 a check is made to determine whether or not the total score T is 201 or more to below 221. If the result of the determination in step 307 is positive, the process continues to step 308. If the result of the determination in step 307 is negative, the process continues to step 309.

In step 308, in addition to the first to the eleventh display units L1 to L11 illuminating in the subroutine II, the twelfth display unit L12 also illuminates, so that a score of 20 is added to the total score T. The process returns to step 102.

In this way, if the total score T is 281 or more to below 301, 301 or more to below 321, 341 or more to below 361, and 481 or more to below 501, all the display units L illuminating in the subroutine II stop illuminating and the total score T is set for 0.

If the total score T is 361 or more to below 381, in addition to the display units L which illuminating in the subroutine II, one more display unit L illuminates, so that a score of 20 is added to the total score T.

If the total score T is 421 or more to below 441, 421, 441 or more to below 461, and 461 or more to below 481, of the display units L which illuminating in the subroutine II, only the last display unit L stops illuminating, so that a score of 20 is subtracted from the total score T.

According to the above-mentioned process of the flow chart, the singing voice score S is displayed with the digital number in the score display 25 each time the singer sings a song and the total score T of the singing voice score S is displayed by the number of the illuminating display unit L. Thus, as the total score T is larger, the number of the illuminating display unit L increases. However if the total score T belongs to the predetermined ranges of the scores to which the above marks M1, M2, M3, are attached, all the illuminating display units L stop illuminating, the number of the illuminating display unit L increases or decreases by one. Thus, with change in the number of the illuminating display unit L, the total score T also changes. Accordingly, even if a singer continues to make a large score S, the number of the illuminating display unit L may not be large if the total score T belongs to one of the predetermined ranges of the scores. As a result thereof, a singer, who continues to make the large total score T, may be delayed in reaching the goal. In contrast thereto, a singer who continues to make the small total score T may reach the goal earlier than a singer who continues to make the large total score T, because the number of the illuminating display unit L showing the small total score T can increase when the small total score T belongs to one of the predetermined ranges of the scores. That is, it depends on the predetermined ranges of the scores whether the total score T can reach the perfect score, namely, the goal earlier. Thus, users of the system of the present invention can enjoy playing a game of contending for reaching the goal earlier, using the predetermined ranges of the scores as well as enjoying making a larger score of the singing voice.

The number of the course should preferably correspond to the number of the singer.

The predetermined ranges of the scores should preferably be provided in the courses with an irregular interval and the interval with which the predetermined ranges of the scores are provided should preferably be changed according to the courses, because a game played with the system of the invention becomes more exciting.

The operation of the display units L of the course 21 can be applied to that of the display units L of the course 22. Therefore, the operation of the display units L of the course 22 is not explained.

What is claimed is:

1. A system for marking a singing voice and displaying a marked result for a karaoke machine, said system comprising:

data storage means for storing a standard singing voice data on a basis of which a singer's singing voice inputted through a microphone when a singer sings is marked, comparison and marking means for comparing the singer's singing voice with the standard singing voice data and marking the singer's singing voice every time the singer sings, score calculation means for calculating a total score marked by the comparison and marking means, first display means having a course for displaying the total score and a final goal corresponding to a predetermined perfect score, the course composed of a chain of a plurality of display units divided into first and second score sections in which scores ranging from a predetermined minimum score to the predetermined perfect score are displayed, and means for controlling the first display means in accordance with a first step and a second step, and wherein:

the first step determines which of the first and second score sections the total score belongs and illuminates the display units provided in the determined one of the first and second score sections in a number corresponding to the total score;

the second step changes the total score calculated by the score calculation means to arrive at a changed total score in accordance with a game rule whereby the number of the display units illuminated by the first step may be increased or decreased based on the changed total score; and the game rule is clarified into three kinds of score sections, namely addition score sections, subtractive score sections and constant score sections, the addition score section in which a predetermined score is added to the total score calculated by the score calculation means if the total score falls within first predetermined ranges, the subtractive score section in which a predetermined score is subtracted from the total score calculated by the score calculation means if the total score falls within second predetermined ranges, and the constant score section in which the total score calculated by the score calculation means is kept constant if the total score falls within third predetermined ranges.

2. The system as claimed in the claim 1, wherein plural kinds of the predetermined scores to be added to or subtracted from the total are provided.

3. The system as claimed in the claim 1, wherein a plurality of the first display means are provided.

4. The system as claimed in the claim 1, wherein second display means is provided, the second display means for displaying a score of the singer's singing voice each time the singer's singing voice is marked by the comparison and marking means.

* * * * *